US006643859B1

(12) United States Patent
Brennan et al.

(10) Patent No.: US 6,643,859 B1
(45) Date of Patent: Nov. 11, 2003

(54) FLUID FLOW SYSTEM WITH FLOW DIVERTER

(75) Inventors: Anthony Brennan, Niskayuna, NY (US); W. John Gardenier, Albany, NY (US); Wesley Cox, Johnstown, NY (US)

(73) Assignee: Saratoga Spa & Bath Co., Inc., Latham, NY (US)

( * ) Notice: Subject to any disclaimer, the term of this patent is extended or adjusted under 35 U.S.C. 154(b) by 0 days.

(21) Appl. No.: 09/858,021

(22) Filed: May 15, 2001

(51) Int. Cl.[7] ..... A61H 33/04
(52) U.S. Cl. ..... 4/541.6; 4/541.1; 4/541.4
(58) Field of Search ..... 4/541.6, 541.4, 4/541.1; 239/394, 505, 506, 512, 518, 513, 451, 521

(56) References Cited

U.S. PATENT DOCUMENTS

| | | | | | |
|---|---|---|---|---|---|
| 2,571,768 | A | * | 10/1951 | Schlonau et al. | 239/513 |
| 2,874,995 | A | * | 2/1959 | Attwell | 239/511 |
| 3,045,829 | A | * | 7/1962 | Rule et al. | |
| 3,094,283 | A | | 6/1963 | Balister | |
| 3,099,986 | A | * | 8/1963 | Guelfi | 4/541.6 |
| 3,613,995 | A | * | 10/1971 | Kane | 239/451 |
| 3,664,586 | A | * | 5/1972 | Harris, Sr. | 239/514 |
| 3,675,252 | A | * | 7/1972 | Ghiz | |
| 3,804,337 | A | * | 4/1974 | Schmidhuber et al. | 239/513 |
| 3,946,449 | A | * | 3/1976 | Mathis | 4/541.6 |
| 4,241,464 | A | * | 12/1980 | Buckwalter | |
| 4,327,867 | A | * | 5/1982 | Jones et al. | |
| 4,347,981 | A | * | 9/1982 | Hayes | |
| 4,520,514 | A | * | 6/1985 | Johnson | 4/490 |
| 4,613,080 | A | | 9/1986 | Benson et al. | 239/542 |
| 4,711,399 | A | * | 12/1987 | Rosenberg | |
| 4,896,384 | A | * | 1/1990 | Dijkhuizen | 4/541.6 |
| 4,953,240 | A | | 9/1990 | Gardenier | 4/542 |
| 5,082,183 | A | | 1/1992 | Dahlin et al. | 239/393 |
| 5,683,035 | A | * | 11/1997 | Wang | |
| 5,746,375 | A | * | 5/1998 | Guo | |
| 5,810,257 | A | | 9/1998 | Ton | 239/259 |
| 5,848,444 | A | * | 12/1998 | Christopherson | 4/541.6 |
| 5,862,543 | A | | 1/1999 | Reynoso et al. | 4/541.6 |
| 5,915,849 | A | | 6/1999 | Dongo | 4/541.6 |
| 5,943,711 | A | | 8/1999 | Loizeaux et al. | 4/541.6 |
| 6,029,912 | A | | 2/2000 | Woolley | 239/428.5 |
| 6,178,570 | B1 | * | 1/2001 | Denst et al. | 4/541.6 |
| 6,182,303 | B1 | | 2/2001 | Gardenier et al. | 4/541.6 |
| 6,185,757 | B1 | | 2/2001 | Gardenier et al. | 4/541.1 |
| 6,351,859 | B1 | * | 3/2002 | Maiuccoro | 4/541.4 |

* cited by examiner

*Primary Examiner*—Gregory Huson
*Assistant Examiner*—Khoa Huynh
(74) *Attorney, Agent, or Firm*—Heslin Rothenberg Farley & Mesiti P.C.; Victor A. Cardona, Esq.

(57) ABSTRACT

A fluid flow system for a spa is provided. The fluid flow system includes an ejector which discharges fluid in a first direction toward an interior of the spa through an outlet of the ejector and a diverter which is moveable to a position within said first direction between the outlet and the interior of the spa. The diverter is adapted to deflect at least a portion of the fluid to a second direction different from the first direction.

25 Claims, 7 Drawing Sheets

FLUID FLOW SYSTEM WITH FLOW DIVERTER

TECHNICAL FIELD

This invention relates, in general, to hydrotherapy tubs and, in particular, to a fluid flow system usable for creating fluid flow in hydrotherapy tubs and a method for controlling fluid flow.

BACKGROUND ART

Hydrotherapy tubs, spa assemblies and like systems have enjoyed increased popularity in recent years. In the majority of such systems, a contained space is at least partially filled with a fluid, such as water, which continuously is circulated throughout the contained space. A fluid directing structure is provided to include one or more jet streams of water directed into the interior of the contained space to create a certain amount of water turbulence.

In a conventional spa assembly or system, the tub or pool like structure is generally formed of rigid material and permanently mounted or fixed either in ground or above ground at a specific location. Fixed plumbing typically in the form of rigid material conduits, pumps, heating structures, etc. are then mounted at this given location in communication with the interior of the rigid material tub or pool to create the desired treatment of water being circulated. Hydrotherapy tubs generally have a number of fluid flow outlets or nozzles. Each flow nozzle usually jets water or a water-air froth into the tub. Enhanced hydrotherapy typically results from strategic positioning of these fluid flow nozzles at various locations in the tub. The one or more flow nozzles located throughout the tub generally direct streams of water to specific locations of the user which aids in hydrotherapy of that location.

Some fluid flow nozzles have the user controlled ability to direct a single jet stream of water into different positions, by rotating or pivoting the fluid flow nozzle. However, providing hydrotherapy to multiple areas at the same time has been limited by the number and placement of the fluid flow nozzles. In general these nozzles have been placed in specific locations by the manufacturer and cannot be relocated without significant work and expense. Therefore, if a user wishes to provide hydrotherapy to two or more locations at the same time, there may be difficultly due to nozzle placement.

Thus, a need exists for enhanced strategic directioning of the fluid flow paths thereby enabling a user to direct fluid, from a single outlet, to more than one location at the same time.

SUMMARY OF THE INVENTION

The present invention provides, in a first aspect, a fluid flow system for a spa. The fluid flow system includes an ejector which discharges fluid in a first direction toward an interior of the spa through an outlet of the ejector and a diverter which is movable to a position within said first direction between the outlet and the interior of the spa. The diverter is adapted to deflect at least a portion of the fluid to a second direction different from the first direction.

The present invention provides, in a second aspect, a fluid flow system for a spa. The fluid flow system includes an ejector which discharges fluid toward an interior portion of the spa through an outlet of the ejector and a diverter ring which surrounds at least a portion of the ejector wherein a circumferential portion of the diverter ring is adapted to alter the direction of fluid discharge.

The present invention provides, in a third aspect, a diverter ring for use with a fluid flow ejector wherein the diverter ring includes a plurality of diverters for altering a direction of fluid discharge from the fluid flow ejector and wherein the diverter ring is connectable to the fluid flow ejector.

The present invention provides, in a fourth aspect, a method of controlling fluid flow of a spa. The method includes providing a diverter between a fluid flow ejector and an interior portion of the spa, discharging fluid from the fluid flow ejector in a first direction, and deflecting at least a portion of the fluid to a second direction different from the first direction.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be apparent from the following detailed description of preferred embodiments taken in conjunction with the accompanying drawings in which:

DETAILED DESCRIPTION

In accordance with the principles of the present invention, a fluid flow system for a hydrotherapy tub or spa and a method of controlling fluid flow are provided. A coplanar flow ejection is disclosed in U.S. Pat. No. 6,182,303, issued on Feb. 6, 2001, the specification of which is hereby incorporated by reference in its entirety. In one aspect of the present invention, a diverter ring is oriented around such a coplanar flow ejection to alter or vary the direction of coplanar flow from the ejector outlet.

Figure 1:
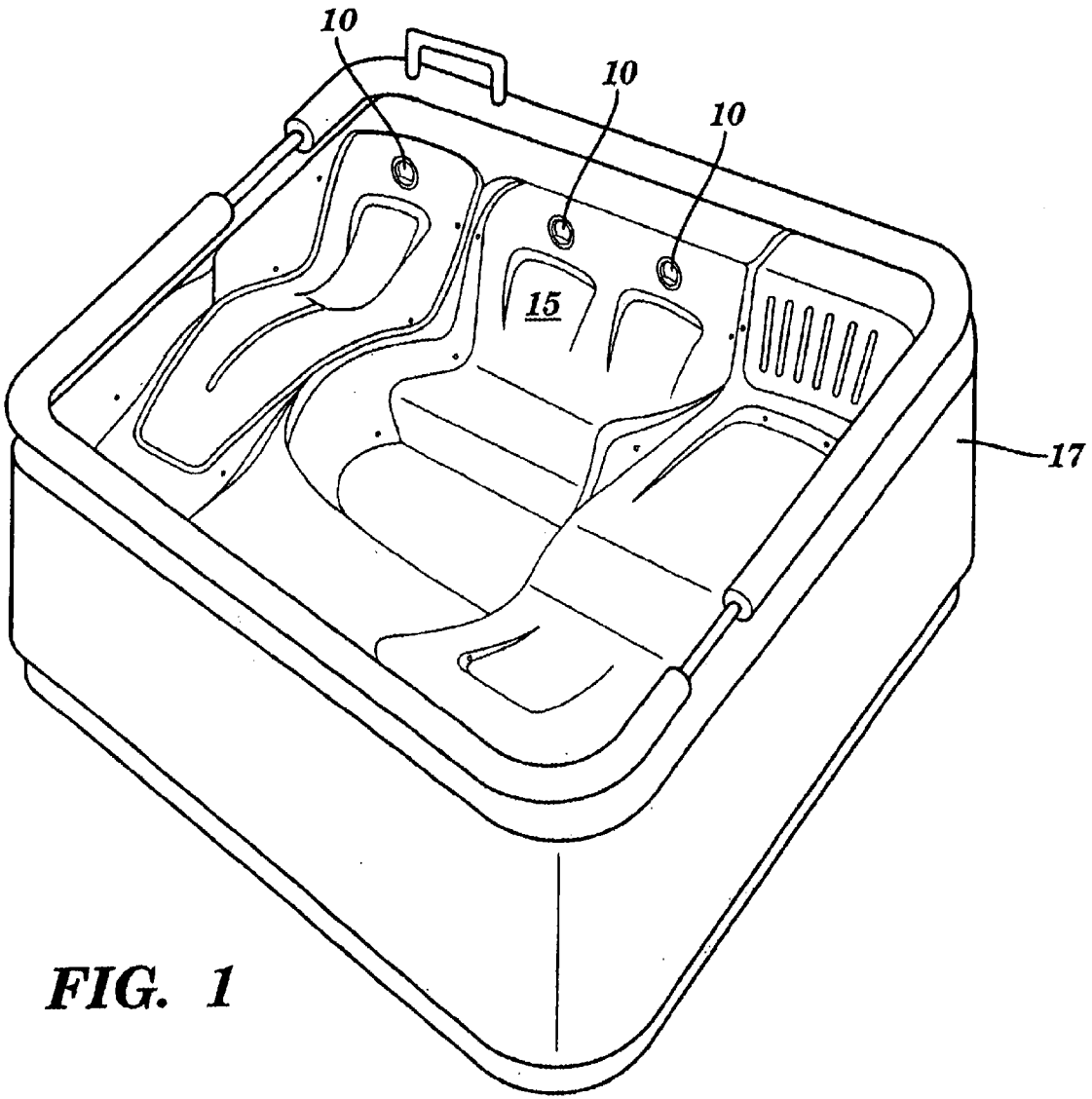
FIG. 1 is a perspective view of a hydrotherapy spa including a fluid flow system in accordance with the present invention.
Figure 2:
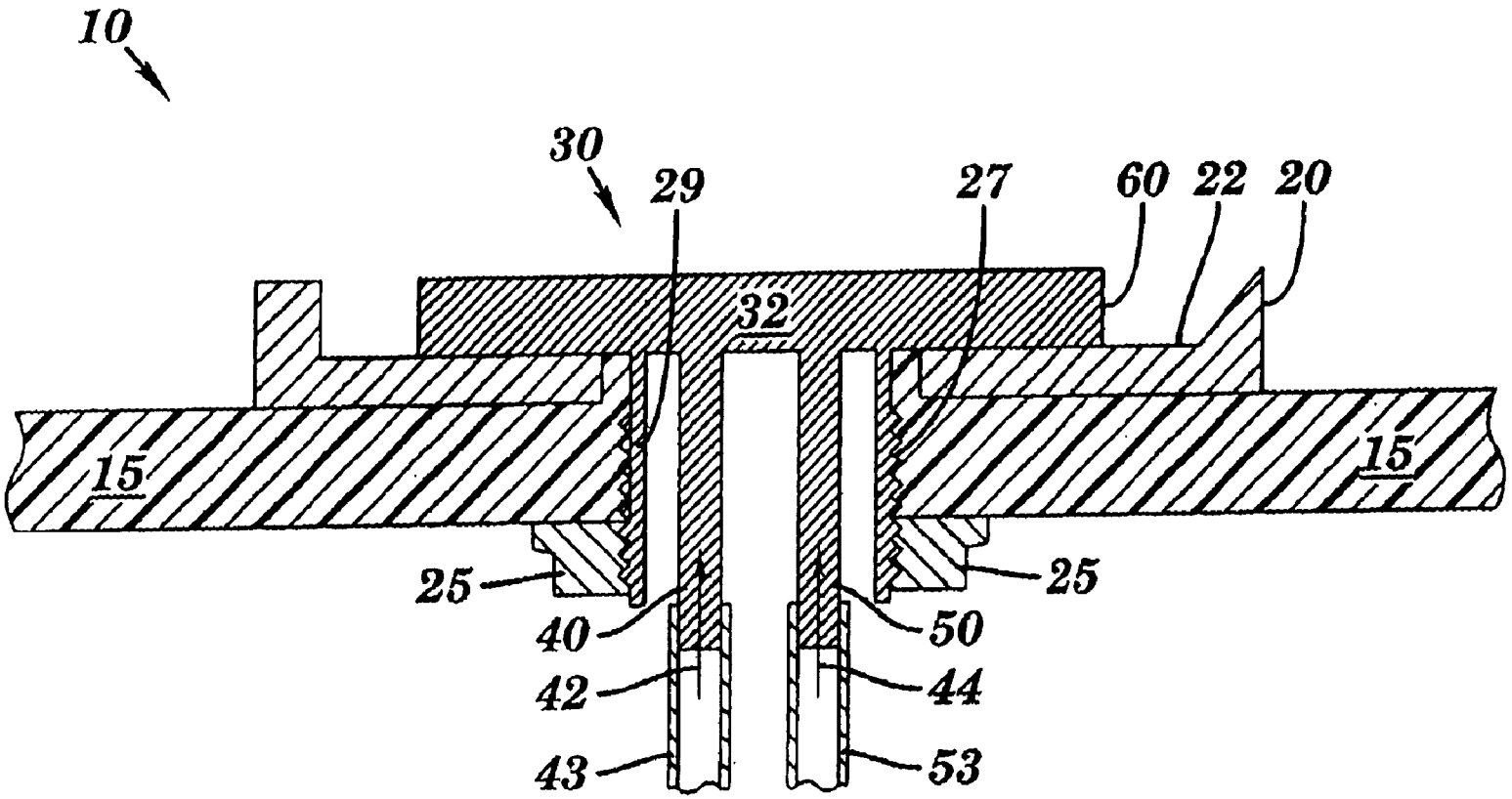
FIG. 2 is a side cross-sectional view of the fluid-flow system of FIG. 1.

In an exemplary embodiment depicted in FIG. 1 and FIG. 2, a fluid flow system 10 is mounted on a wall 15 of a hydrotherapy tub or spa 17. Fluid flow system 10 includes a diverter ring 20 which may be rotatable about a coplanar flow ejector 30. Coplanar flow ejector 30 receives air and water through an air inlet 40 and a water inlet 50, respectively. Alternatively, other fluids besides air and water, respectively, might enter air inlet 40 and water inlet 50. For example, both inlets might be supplied with water, or one of the inlets might be supplied with a soapy water.

Water inlet 40 is in fluid communication with a supply of water and air inlet 50 is in fluid communication with a supply of air via water conduit 53 and air conduit 43 preferably a pressurized water source and an unpressurized air source, respectively. The fluid enters in the direction of arrows 42 and 44 through water inlet 40 and air inlet 50. It is directed through body 32 of coplanar flow ejector 30 and exits through an outlet 60. In this configuration, the supplies of water and air are directed to flow in a substantially coplanar flow until the flow contacts the edge of the diverter ring 20. The term coplanar flow includes and refers to the flow of a fluid from an opening in the form of a plane along a surface, typically, as shown in U.S. patent application Ser. No. 09/464,111, along the inner surface of the tub or hydrotherapy spa, in substantially the same plane as the inner surface. However, as disclosed herein, flow from a coplanar flow ejector 30 may create a coplanar flow along a radially inner surface 22 of diverter ring 20.

Figure 3:
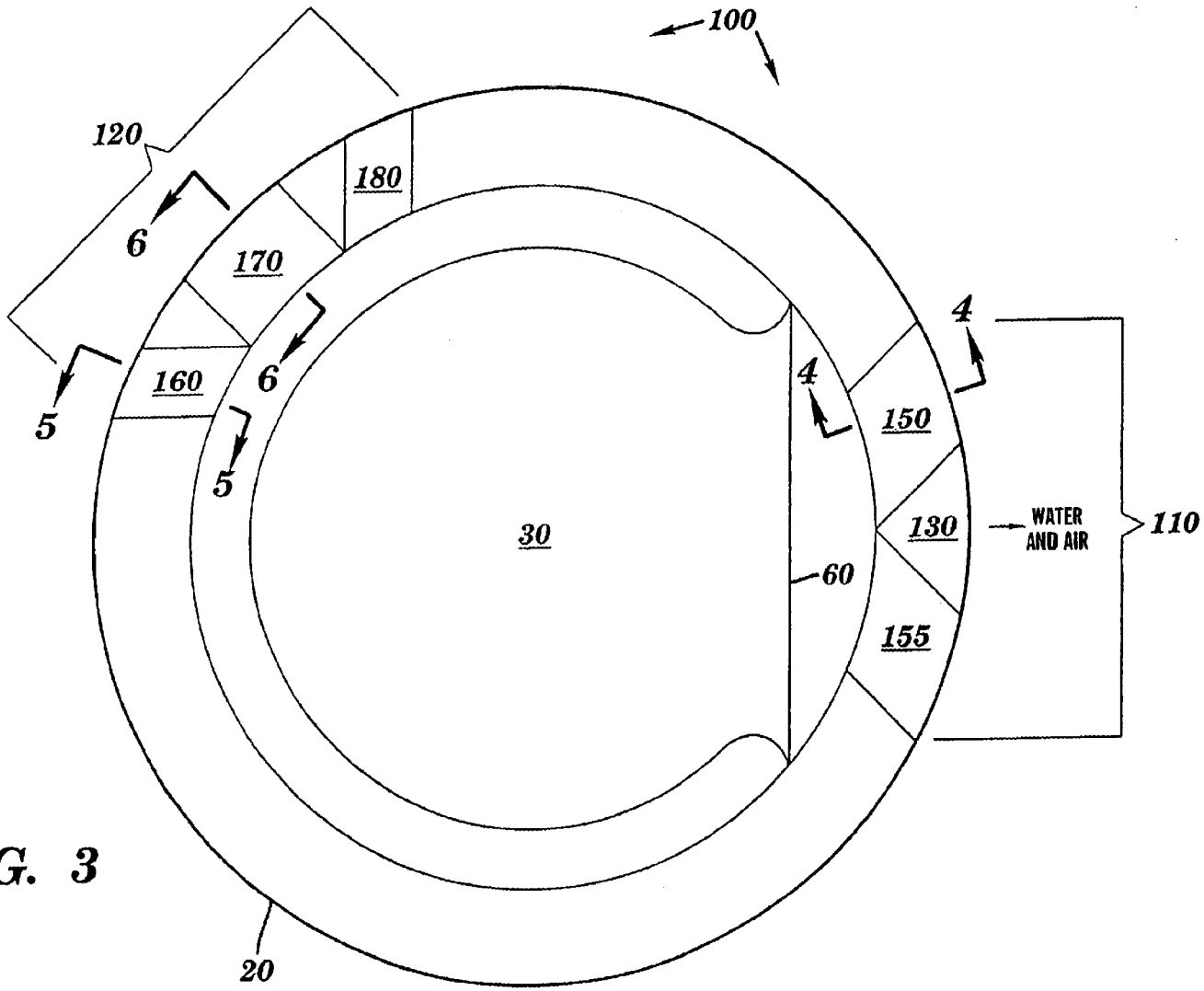
FIG. 3 is a top view of the fluid flow system of FIG. 1.

As depicted in FIG. 3, diverter ring 20 includes a plurality of circumferential portions, or diverters 100 located between outlet 60 and the interior of the spa 17 (FIG. 1) for altering a direction of a stream of water and/or air. Diverter ring 20 might be rotatable around or about coplanar flow ejector 30 in various planes and thus around various axes. For example, diverter ring 20 might be located in a plane in which outlet 60 is located and thus rotatable around an axis about perpendicular thereto, as illustrated in FIGS. 2–3. Also, diverter ring 20 may be in a plane oblique to the discharge of water through outlet 60. Diverter ring 20 might also be located in a plane about perpendicular to air conduit 40 and water conduit 50, and thus rotatable around an axis about parallel to air conduit 40 and water conduit 50, as illustrated in FIGS. 2–3.

As described above, diverter ring 20 may include a plurality of diverters 100 spaced around the circumference thereof Diverter ring 20 may also be rotatable around or about outlet 60 to cause diverters 100 located around its circumference to be located between outlet 60 and the interior of spa 17 (FIG. 1). For example, a first position of diverter ring 20, as illustrated in FIG. 2, might have a first diverter 110 adjacent to outlet 60 and between outlet 60 and the interior of the spa 17 (FIG. 1). Discharge of water from outlet 60 in this position toward diverter 110 causes a stream of water and air to be deflected or split into two directions toward the interior of the spa.

Figure 4:
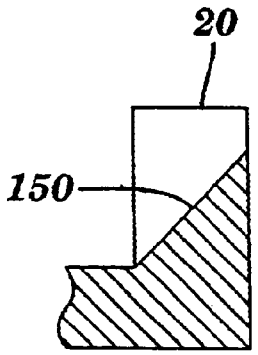
FIG. 4 is a cross-sectional view taken along line 4—4 of FIG. 3.

First diverter 110 of diverter ring 20 includes a wedge shaped portion 130, an inclined portion 150, and an inclined portion 155. As depicted in FIG. 4 inclined portion 150 has a low end closest to outlet 60 and a highest end furthest from outlet 60. Inclined portion 155 might be a mirror image of inclined portion 150 or it might be inclined or declined at a different angle from inclined portion 150. A stream of water and air exiting outlet 60 may be diverted by inclined portion 150 to a direction oblique and inclined from a direction of the stream of water and air as it exits outlet 60.

Figure 5:
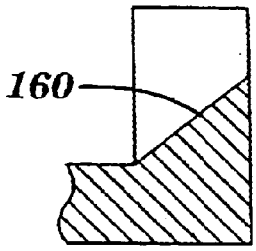
FIG. 5 is a cross-sectional view taken along line 5—5 of FIG. 3.
Figure 6:
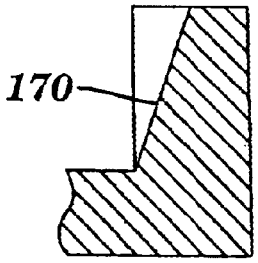
FIG. 6 is a cross-sectional view taken along line 6—6 of FIG. 3.

Returning to FIG. 3, diverter ring 20 might be rotated around coplanar flow ejector 30 to a second position to allow a second diverter 120 to be adjacent to outlet 60 and thus between outlet 60 and the interior of the spa. A discharge of water and air from outlet 60 would serve to divert a stream of water and air from outlet 60 into different directions, for example into three streams having three different directions. Diverter 120 includes inclined portions 160, 170, and 180 which may deflect a stream of water and air from a direction in a plane with outlet 60 to one or more directions oblique from outlet 60. Inclined portion 160 is illustrated in FIG. 5 and inclined portion 170 is illustrated in FIG. 6 while inclined portion 180 is a mirror image of inclined portion 160.

As will be understood by those skilled in the art, diverters 100 might be formed such that the flow of water and air is diverted or deflected resulting in one or more resultant streams proceeding past diverters 100 in the same plane as that of outlet 60 or in a plane different therefrom. Alternatively, wedge shaped portion 130 (FIG. 3) might have a different shape, for example it may be narrower, wider, or discontinuous. Inclined portions 150 and 155 (FIGS. 3–4) might be inclined differently, for example, parallel to the direction of the stream of water exiting outlet 60 or declined such that their high ends are closest to outlet 60 and their low ends are furthest from outlet 60.

A decreased cross-sectional area, for flow of the pressurized fluid, formed by interposition of diverter ring 20 between outlet 60 and the interior of the spa might yield increased flow velocity of the fluid as it exits fluid flow system 10. This increased stream velocity of the fluid provides fluid flow strong enough to provide sufficient hydrotherapy effects. Various aspects of the invention related to such flow features, system dynamics, and/or hydrodynamics, will be appreciated by those skilled in the art.

Figure 7:
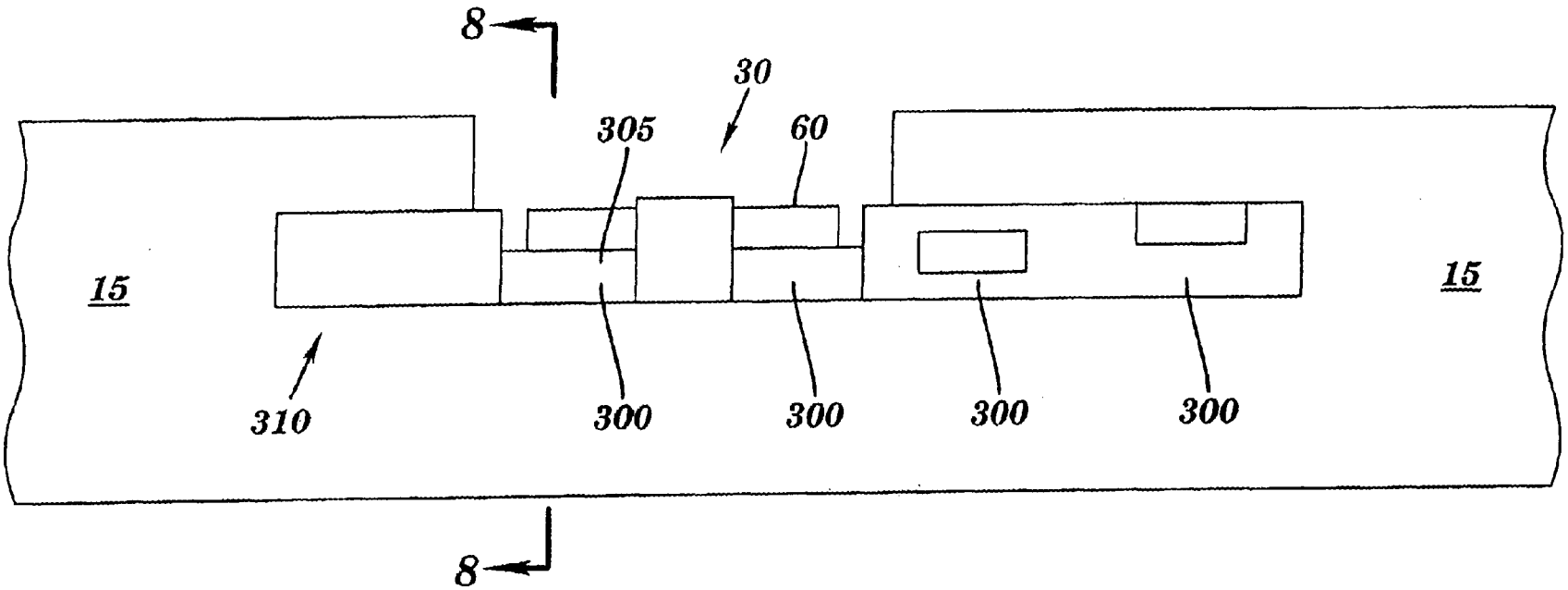
FIG. 7 is a side elevational view of a plurality of diverters in accordance with the present invention.
Figure 8:
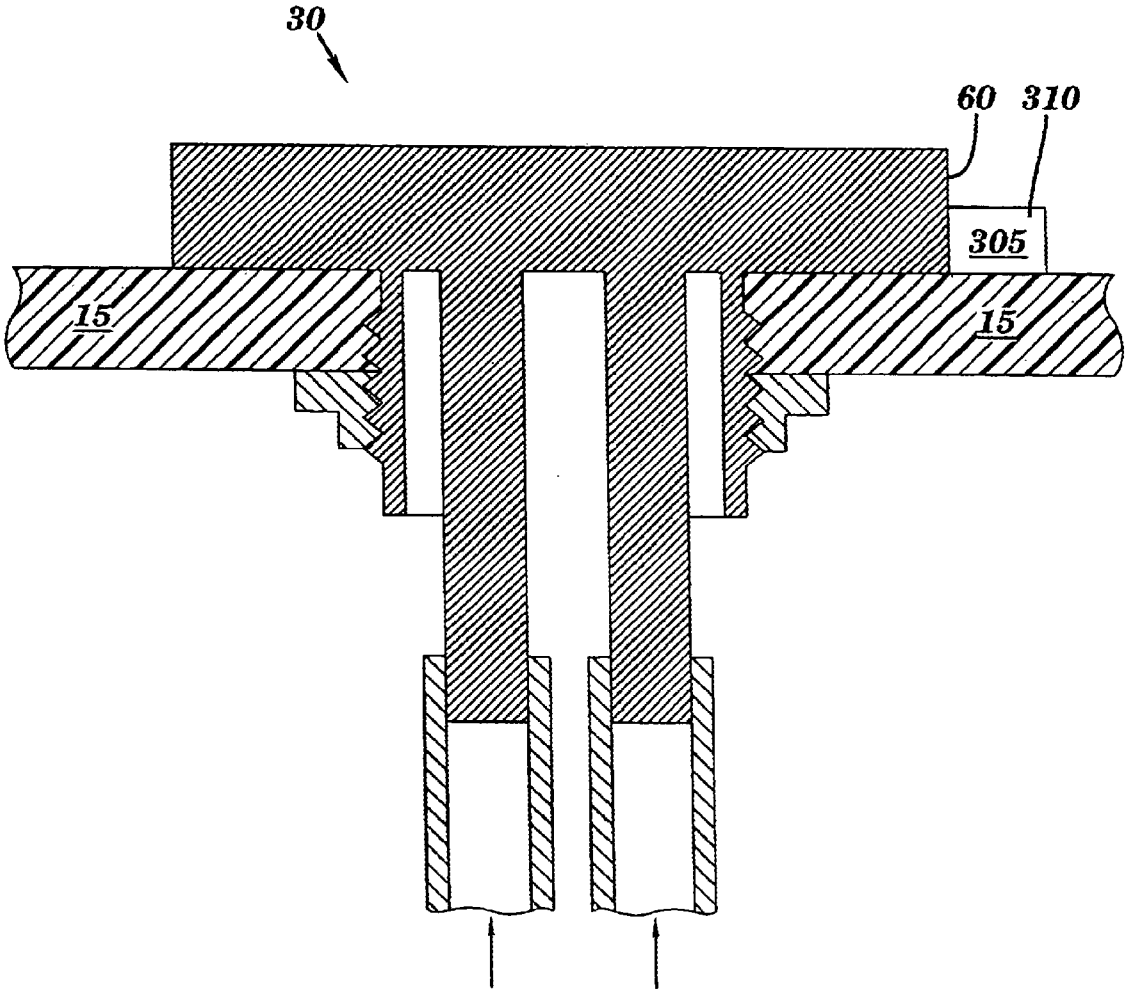
FIG. 8 is a cross-sectional view taken along line 8—8 of FIG. 7.
Figure 9:
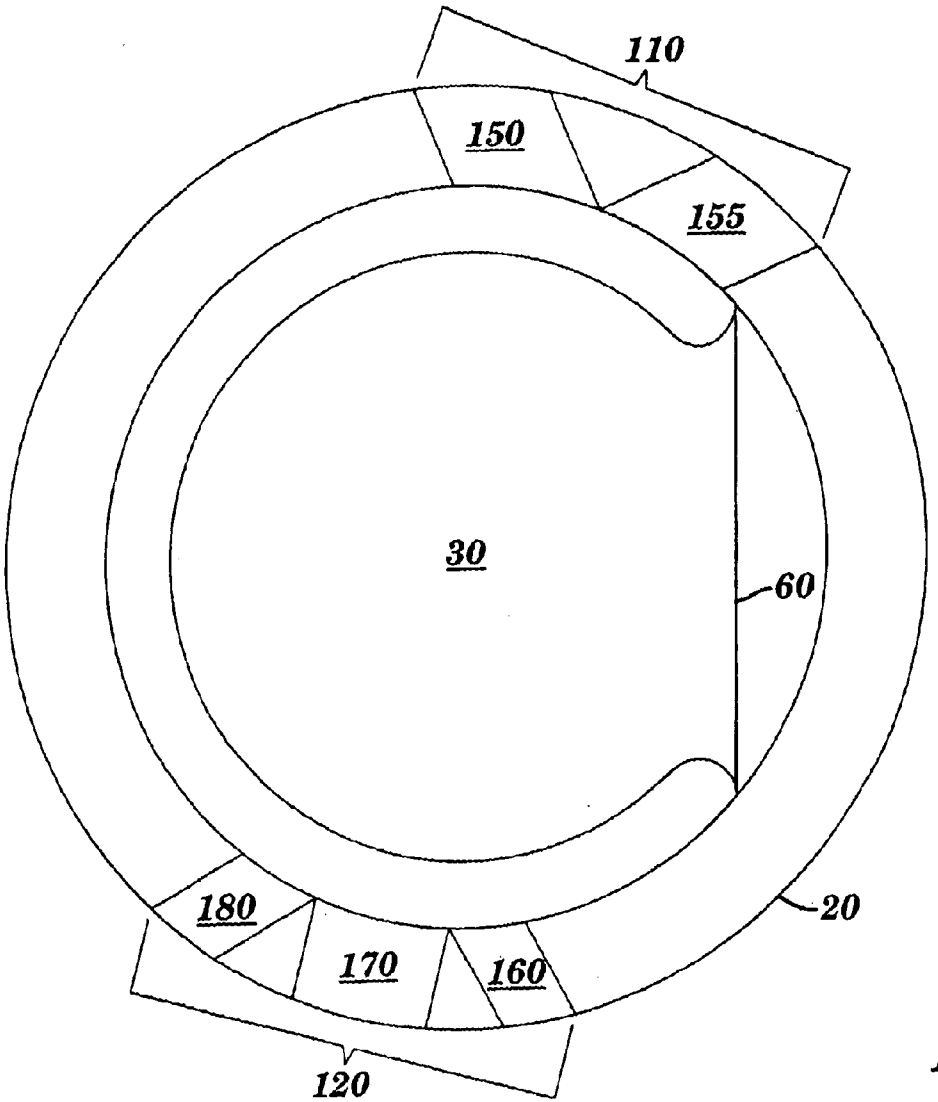
FIG. 9 is a top view of the fluid flow system of FIG. 3 with a diverter ring thereof located in a position different than that presented in FIG. 3.

It will also be evident to those skilled in the art that diverters 100 may be arranged other than in a ring and may be movably connected to the spa in various other ways, allowing them to be transposed between the outlet of the ejector and the interior of the spa. For example, in another embodiment of a diverter arrangement depicted in FIG. 7, diverters 300 may be formed in a continuous strip 310 mounted to the spa such that lateral movement of strip 310 causes one diverter of a plurality of diverters to be located between an outlet of the ejector and the interior of the spa. For example, as illustrated in FIG. 8, a diverter 305 of strip 310 of diverters is located between outlet 60 and the interior of the spa. Diverter 305 may deflect a stream of water and/or air, such that it enters the spa only from the upper portion of outlet 60, for example.

Furthermore, returning to FIG. 2, fluid-flow system 10 may include sidewalls 29 surrounding inlets 40 and 50. For instance, the sidewalls may include exterior threads 27 for mating with a nut 25 in order to securely position fluid flow system 10 on the tub wall 15.

In one example, fluid flow system 10 is mounted to tub wall 15 using epoxy or a similar water-tight sealant. The epoxy forms a fluid-tight seal that safeguards the contents of the hydrotherapy tub. In one preferred embodiment, the epoxy affixes fluid flow system 10 in a position that extends through part of the tub inner surface. The body, epoxy, and chamber cooperate to further provide a safe housing for the secure fastening of inlets 40 and 50 to respective fluid supply conduits. Fluid flow system 10 may be affixed in a recess of tub wall 15.

In one embodiment, the various components, layers, or parts of fluid flow system 10 are molded of ABS plastic. As one example, any number of parts of the fluid flow system may be injection-molded. For instance, any number of the parts of the fluid flow system may be unitary and/or integral. In one example, inlets 40 and 50 and/or tub wall 15 with threads 27 may be unitary and/or integral, such as may be done by injection molding. As another example, one may selectively secure the system parts by techniques such as heating or gluing. For instance, layers/plates/portions could be heated along certain interfaces.

A hydrotherapy tub may be equipped with multiple cooperating instances of hydrotherapy-tub fluid flow systems (e.g. such as fluid flow system 10), in accordance with the present invention. As mentioned above, coplanar flow ejector 30 advantageously provides substantially coplanar flow relative to the local inner surface of the spa, and positioning of diverter ring 20 provides selective directional flow as desired by a user.

For instance, several of the fluid flow systems may be positioned in parallel in order to advantageously provide the coplanar flow in the form of overall sheets of injected fluid, as well as directional flow in one or multiple directions as selected by the user. The tub contours already anticipate and promote desirable postures of users in seated and reclined positions. The fluid flow systems further promote hydrotherapy by extending the coplanar flow between a tub inner surface and along the outer skin of the user for massaging, as well as in other user selected directions to aid in hydrotherapy of additional body areas.

While part(s) of the description herein, for explanatory purposes, may imply certain exemplary direction(s), such direction(s) may be considered relative. For example, by changing the angle of portions of diverters 100 (FIG. 3), the direction of the fluid flow will vary, and by having a substantially parallel set of inner walls a generally straight fluid flow might result. Therefore by using different diverters 100 (FIG. 3) of diverter ring 20 (FIGS. 2–3) with differing angles the user may customize the directional fluid flow to suit their particular hydrotherapy needs. Design choice(s) allow accommodation(s) of any orientation(s) for any device (s) in accordance with the principles of the present invention.

Numerous alternative embodiments of the present invention exist. For instance, threaded interconnections could easily mount fluid flow system 10 (FIGS. 1–3) on spa wall 15 (FIGS. 1–2), or fasten air inlet 40 (FIG. 1) and water inlet 50 (FIG. 2) to fluid supply conduits. Further, the fluids could easily be liquid or gas. Moreover, each fluid could easily include a group of fluids. Also, more than two fluids could easily be merged into substantially coplanar flow. Additionally, any number of the systems (e.g., fluid flow system 10) could easily be secured by mechanisms such as tub wall 15 (FIGS. 1–2) with mating threads 27 and nut 25 (FIG. 2). Furthermore, fluid flow system 10 (FIGS. 1–3) could easily be fixed in any desired direction relative to a given incline of tub wall 15 (FIGS. 1–2).

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A fluid flow system for a hydrotherapy spa comprising:

an ejector attachable to the spa and configured to receive fluid through at least one fluid supply conduit of the spa, said ejector being configured to discharge the fluid in a flow path in a first direction within an interior of the spa through an outlet of said ejector when said ejector is attached to the spa;

a diverter disposed coplanar to said outlet, said diverter being movable from a first position outside a flow path to a second position external to said ejector, said second position being within the flow path between said outlet and said interior of the spa when said ejector is attached to the spa; and wherein said diverter is adapted to deflect at least a portion of the fluid to a second direction different from said first direction, when said diverter is in said second position and said ejector is attached to the spa, and wherein said diverter avoids the fluid when said diverter is in said first position and said ejector is attached to the spa.

2. The system of claim 1 further comprising a diverter ring comprising said diverter.

3. The system of claim 2 wherein said diverter is a first diverter of a plurality of diverters on said diverter ring.

4. The system of claim 1 wherein said ejector is a coplanar fluid flow ejector.

5. The system of claim 3 wherein said ejector is a coplanar fluid flow ejector.

6. The system of claim 5 wherein said diverter ring is rotatable around an axis about perpendicular to said first direction.

7. The system of claim 4 wherein said coplanar fluid flow ejector discharges said fluid in a substantially coplanar flow in said first direction and said diverter deflects said at least a portion of said fluid in said second direction at an angle from said first direction.

8. A fluid flow system for a spa, comprising:

an ejector attachable to the spa and configured to receive fluid from at least one fluid supply conduit of the spa, said ejector being configured to discharge fluid in a flow path toward an interior portion of the spa through an outlet of said ejector when said ejector is attached to the spa;

a diverter ring located coplanar to said outlet and rotatable around said ejector;

and wherein a circumferential portion of said diverter ring is adapted to alter a direction of fluid discharge in response to said circumferential portion being rotated from a position outside the flow path to a position within the flow path between said outlet and the interior portion when said ejector is attached to the spa, and wherein said diverter avoids the fluid when said diverter is in said position outside the flow path.

9. The system of claim 8 wherein said circumferential portion is movable to a position between said outlet and the interior portion of the spa.

10. The system of claim 8 wherein said diverter ring is rotatable around an axis about perpendicular to a direction of fluid discharge from said outlet.

11. The system of claim 8 wherein said circumferential portion is a first circumferential portion and said diverter ring comprises a plurality of circumferential portions.

12. The system of claim 8 wherein said diverter ring is rotatable in a same plane as said outlet.

13. The system of claim 8 wherein said ejector is a coplanar fluid flow ejector.

14. The system of claim 10 wherein the direction of the fluid discharge is substantially coplanar to an inner surface of said spa.

15. A diverter ring for use with a fluid flow ejector configured to be attached to a wall of a hydrotherapy spa to allow the ejector to receive fluid through the wall, the fluid flow ejector having an outlet for discharging fluid in a first direction to an interior of the spa when the fluid flow ejector is attached to the wall, said diverter ring comprising:

plurality of diverters for altering a direction of fluid discharge from said fluid flow ejector and wherein said diverter ring is configured to connect to said fluid flow ejector to allow said diverter ring to rotate around said ejector and about an axis substantially perpendicular to the first direction to allow said plurality of diverters to be selectively located between the outlet and the interior, when the fluid flow ejector is attached to the wall.

16. A method of controlling fluid flow of a spa, comprising:

moving a diverter, which is operatively connected to the spa and disposed coplanar to an outlet of a fluid flow ejector attached to the spa, from a first position outside a flow path of the outlet to a second position external to the ejector, the second position being between the fluid flow ejector and an interior portion of the spa;

discharging fluid from the fluid flow ejector in a first direction; and avoiding contact between the diverter and the fluid, when the diverter is in the first position;

deflecting at least a portion of the fluid to a second direction different from the first direction by the diverter, in response to the moving the diverter to the second position.

17. The method of claim 16 wherein the deflecting comprises deflecting by the diverter.

18. The method of claim 16 wherein the diverter comprises a diverter ring having one or more diverters.

19. By (The method of claim 18 further comprising rotating the diverter ring to position the one or more diverters between the fluid flow ejector and the interior portion of the spa.

20. The method of claim 16 wherein said diverter is a first diverter of a plurality of diverters and further comprising moving a second diverter of the plurality of diverters to a position between the ejector and the interior portion of the spa.

21. The method of claim 16 wherein the discharging fluid comprises discharging fluid in a substantially coplanar flow in said first direction and said diverter deflects said at least a portion of said fluid in said second direction at an angle from said first direction.

22. The method of claim 16 wherein the discharging fluid comprises discharging at least one of water and air.

23. The method of claim 16 wherein said fluid is discharged in a coplanar flow.

24. A hydrotherapy spa, comprising:

an interior portion;

an ejector attached to the interior portion and configured to discharge fluid in a flow path in a first direction within said interior portion through an outlet of said ejector; and a diverter operatively connected to the spa and disposed coplanar to said outlet, said diverter being movable from a first position outside the flow path to a second position external to said ejector, said second position being within said flow path between said outlet and said interior portion, said diverter avoiding contact with the fluid in said first position; and wherein said diverter is adapted to deflect at least a portion of the fluid to a second direction different from said first direction, when said diverter is in said second position.

25. The system of claim 24 further comprising a diverter ring wherein said diverter comprises a first diverter of a plurality of diverters of said diverter ring.

* * * * *